US006231209B1

(12) United States Patent
Leibig et al.

(10) Patent No.: US 6,231,209 B1
(45) Date of Patent: May 15, 2001

(54) LIGHT FIXTURE WITH A LINEAR LIGHTING FIELD, SUITABLE FOR FORMING LIGHTING TRUNKING

(75) Inventors: Joachim Leibig, Traunwalchen; Helmut Zahnbrecher, Palling; Jürgen Brüggemann, Traunreut; Hermann-Reinhard Segers, München; Peter Balk, Übersee, all of (DE)

(73) Assignee: Siteco Beleuchtungstechnik GmbH, Traunreut (DE)

( * ) Notice: Subject to any disclaimer, the term of this patent is extended or adjusted under 35 U.S.C. 154(b) by 0 days.

(21) Appl. No.: 09/171,437

(22) PCT Filed: Feb. 19, 1998

(86) PCT No.: PCT/EP98/00963

§ 371 Date: Mar. 19, 1999

§ 102(e) Date: Mar. 19, 1999

(87) PCT Pub. No.: WO98/37360

PCT Pub. Date: Aug. 27, 1998

(30) Foreign Application Priority Data

Feb. 19, 1997 (EP) ..... 97 102 709

(51) Int. Cl.[7] ..... F21S 4/00
(52) U.S. Cl. ..... 362/219; 362/260; 362/408
(58) Field of Search ..... 362/219, 221, 362/260, 404, 408

(56) References Cited

U.S. PATENT DOCUMENTS

| | | | | |
|---|---|---|---|---|
| 3,070,689 | | 12/1962 | McIntosh . | |
| 3,599,911 | | 8/1971 | Monte . | |
| 4,726,781 | * | 2/1988 | Bernhart et al. | 362/219 X |
| 4,866,581 | | 9/1989 | Targetti . | |
| 5,658,066 | * | 8/1997 | Hirsch | 362/219 |

FOREIGN PATENT DOCUMENTS

| | | |
|---|---|---|
| 1 235 677 | 3/1967 | (DE) . |
| 91 04 339 | 9/1992 | (DE) . |
| 43 00 415 | 7/1994 | (DE) . |
| 43 42 657 | 5/1995 | (DE) . |
| 195 31 351 | 2/1997 | (DE) . |
| 0 264 857 | 1/1991 | (EP) . |
| 0 486 714 A1 | 5/1992 | (EP) . |
| 0 486 714 B1 | 5/1992 | (EP) . |
| 2 680 560 | 2/1993 | (FR) . |
| WO 94/22612 | 10/1994 | (WO) . |

* cited by examiner

*Primary Examiner*—Stephen Husar
(74) *Attorney, Agent, or Firm*—Schiff Hardin & Waite

(57) ABSTRACT

In a long field lighting fixture or lighting fixture with a linear lighting field, which is capable of forming a light screen or row of light fixtures that is reduced to its functionally critical parts, the lamp housing is composed of a single-piece reflector arrangement that is fashioned mirror-symmetrically with reference to a vertical middle lamp plane. This is composed of a thin-walled material whose surface is finely structured in a stiffening fashion by surface shaping at least in sub-areas. Facing away from its light exit opening, the reflector arrangement also comprises a pair of outwardly salient, mutually spaced legs, which are spaced apart by a cover surface, for the acceptance of electrical and/or mechanical lighting fixture component parts. Connector elements for a screen arrangement are formed either by end face parts or plates of the lighting fixture itself or by individual elements. To that end, the end face parts comprise a plug channel on an inside surface facing toward the reflector arrangement which channel corresponds to the profile thereof. A tongue and groove profile is provided on the outside surface by which two end face parts can be joined in one another and align a pair of fixtures with identical contour. Further structural elements and components of the lighting technology supplement the lighting fixture structure to form a lighting fixture system.

17 Claims, 3 Drawing Sheets

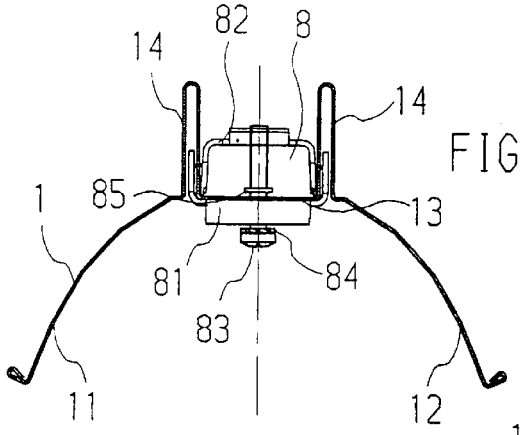
FIG.9
FIG.12
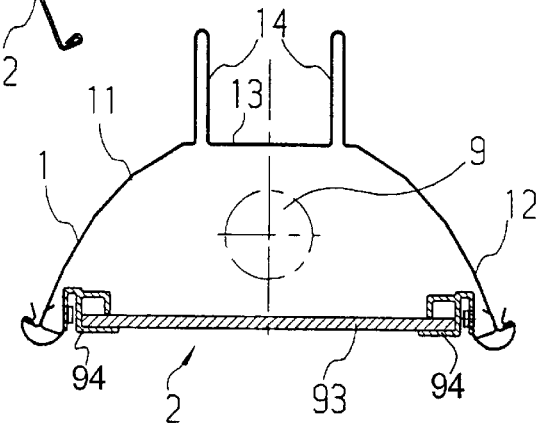
FIG.10
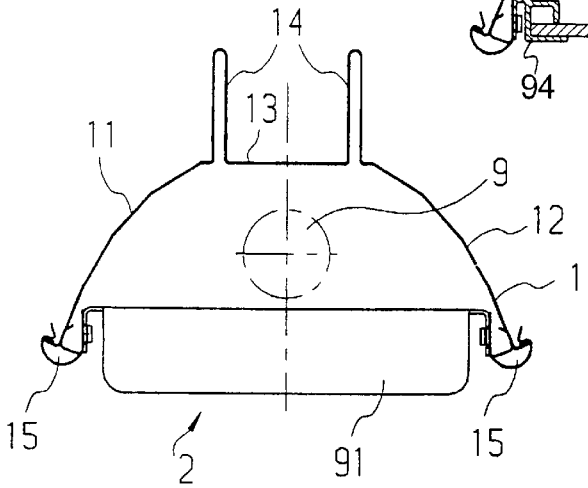
FIG.11
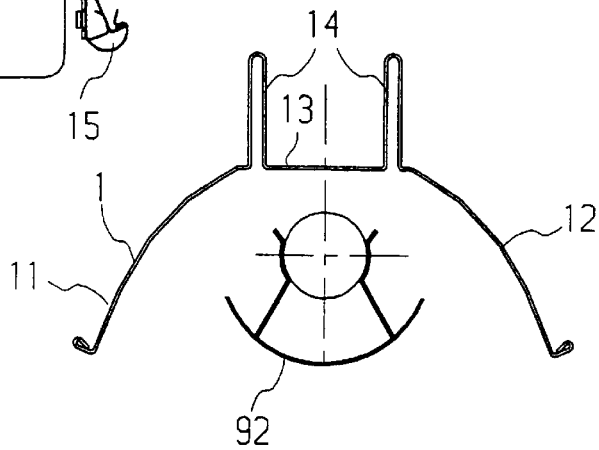

LIGHT FIXTURE WITH A LINEAR LIGHTING FIELD, SUITABLE FOR FORMING LIGHTING TRUNKING

BACKGROUND OF THE INVENTION

The invention is directed to a long field lighting fixture or light fixture with a linear lighting field, which is capable of forming a light screen and has a trough-shaped lamp housing securable to the ceiling of a room via suspensions or directly at whose end walls connector elements are provided for optionally joining individual long field lamps directly to one another to form a light screen or a ribbon of light fixtures.

Lighting equipments for large-area rooms are often realized in the form of light screen systems wherein a plurality of lighting fixtures, are frequently placed directly against one another, to form a straight-line lighting fixture system that appears closed. In large-area rooms such as assembly, manufacturing or storage halls but also in sports arenas, such light screens are preferably arranged in a longitudinal direction of such a room, and also in a plurality of rows parallel to one another.

EP-B1-0 486 714, for example, discloses light screen systems of said species. The bearing structural element in such a light screen system is a carrying rail having a length that can accept a plurality of lighting fixture inserts. A through wiring is usually provided in the carrying rail for the electrical supply of the light sources. The lighting fixture inserts often have a base member with an essentially flat carrying plate that is attached to the carrying rail during assembly of the light screen and is secured thereto with turn-lock fasteners. The carrying plate serves as a receptacle for all electrical as well as mechanical elements of a lighting fixture. All of these elements except lamp sockets are thereby preferably pre-mounted on the upper side of the carrying plate and arranged such that they immerse into the cross-section of the carrying rail when the lighting fixture insert is mounted. In many known light screen systems, a lamp reflector, a lamp housing together with grid or a lamp covering are individually detachably secured to this carrying plate of a lamp insert. The same turn-lock fasteners with which the carrying plate itself is to be fixed to the carrying rail are often employed for the fastening.

As a result of its modularity, this known structure of the light screen systems enables an extraordinary flexibility in the lighting fixture arrangement and selection, so that individual lighting jobs can be solved in different ways with such light screen systems. Added thereto is that, due to their modular structure, such light screen systems can also be adapted without further ado to changing demands made of the room lighting, for example given a different room use. One disadvantage of this basic format of known light screen systems having a plurality of individual components is the relatively high outlay caused by the inherently desired modularity, this being expressed in the tool, manufacturing and warehousing costs.

As derives from DE-C1-43 42 657, this disadvantage has already been recognized. This document discloses a lighting fixture unit for light screen systems whose special characteristic is that an illumination means therein, particularly in the form of one or more fluorescent lamps arranged in a lighting fixture unit, is no longer fixed to the carrying plate of the lamp insert but—via lamp sockets—is directly fixed to the carrying rail of the light screen system. This known lighting fixture unit for a light screen system thus foregoes a carrying plate inserted into the opening of the carrying rail, i.e. the plate is eliminated. Instead, the reflector unit of the lamp insert serves directly as a covering of the carrying rail that is open in the direction toward the illuminated surface. In order to be able to realize this simplification of the structural format of a lighting fixture unit for a light screen system, all electrical and mechanical components of a lighting fixture, including the sockets for the illumination means, are directly introduced into the free cross-section of the carrying rail and fixed thereat. The reflector arrangement with which the carrying rail is covered at its surface directed into the room must then be fashioned such that the sockets secured to the carrying rail can be plugged through the reflector arrangement or, respectively, that corresponding cutouts for the acceptance of the plug-in sockets are provided at their end edges.

Given this known solution, a certain disadvantage must be accepted in view of the assembly and maintenance friendliness in order to achieve a simpler and, thus, more cost-beneficial lighting fixture structure. Viewed from this point of view of cost benefit, however, the known solution can still not fully satisfy because the elimination of only a carrying plate means a relatively slight cost reduction compared to the disadvantages of less of a scope of variation thus accepted.

Further, lighting fixtures capable of forming a light screen are known and have a trough-shaped lamp housing which is either directly attachable to a ceiling or held by suspensions and the fixture has housing wall parts at the face side that can be directly attached to one another for forming a light screen or a row of light fixtures. A carrying rail is not utilized given these lighting fixtures; instead, the housings of the individual lighting fixtures are fashioned correspondingly stable and such that, in addition to accepting the illumination means and the reflector arrangement surrounding them, they also accept the electrical and mechanical component parts and also enable a through wiring when employed in a screen arrangement.

U.S. Pat. No. 3,599,911 discloses an example of such a lighting fixture capable of forming a light screen. Therein, end wall parts of the lamp housing are fashioned as punched sheet metal parts with angled-off edges via which they are secured to the lamp housing with screws or rivets. In order to be able to mutually anchor the end wall parts, the end wall parts have hooks and eyelets arranged in alternation. For joining end wall parts, these must first be placed against one another offset relative to one another in a transverse direction so that the hooks can be introduced into the corresponding eyelets. A transverse motion of the joined end wall parts is then required for locking the hooks. The assembly process for a light screen is therefore relatively involved and requires an additional adjustment in order to achieve an exact alignment of the joined lighting fixtures.

EP-B-0 264 857 also discloses a long field lighting fixture capable of forming a light screen wherein terminating plates are provided as adapter elements at the end walls of the lamp housing whose outsides comprise plug in frames respectively joining into one another in the fashion of stackable elements. Long field lighting fixtures can thus be attached to one another aligned by simply plugging the outsides of these terminating plates together. However, a further end cap is then required for the end-face termination of a single lighting fixture or the end of a light screen.

SUMMARY OF THE INVENTION

The present invention is based on the object of creating a further embodiment of a lighting fixture capable of forming a light screen or a row of light fixtures which have a trough-shaped housing, which is either directly securable to the ceiling or can be suspended therefrom and which has end wall parts with means for connecting fixtures one to another in a row. The fixture can be especially cost-beneficially manufactured in the limitation to purely functional features but thereby nonetheless offers contemporary lighting technology in an attractive lighting fixture design and, at the same time, can be comfortably utilized by the assembler and without tools, potentially in a screen arrangement as well.

In a lighting fixture capable of forming a light screen of the aforementioned species, this object is inventively achieved by the housing being formed by a single reflector arrangement, which is fashioned mirror-symmetrically with reference to a vertical middle lamp plane containing the longitudinal lamp axis, said reflector arrangement being fabricated of a thin-walled, web-shaped reflective material whose surface is finely structured in a stiffening fashion by surface shaping at least in sub-areas and, facing away from a light exit opening of the housing, comprises a pair of outwardly salient, mutually spaced legs for the acceptance of electrical and/or mechanical lighting fixture component parts and by connector elements that are respectively fashioned as a universal single-part end face part whose inside surface facing toward the reflector arrangement comprises a plug channel corresponding to a profile of the reflector arrangement and whose outside surface has a tongue and groove profile composed of a plurality of channels and tongues of identical width that are parallel to one another as well as to the center plane of the lighting fixture and follow one another in alternation, said tongue and groove profile being arranged to be asymmetrical to the center plane of the lighting fixture so that identically fashioned end face parts are joinable in one another at the end side in pairs and aligning with the same contour.

Compared to the initially cited, relatively involved, known solutions for light screen systems having lighting fixture units introducible into carrying rails, this inventive solution has the great advantage of an especially simple structural format. It can be utilized both as an individual lighting fixture as well as in a light screen without requiring additional component parts for assembling the light screen. It offers the advantage of the rail systems of a ceiling-side arrangement of the electrical and mechanical component parts of a lighting fixture with a simple through wiring in a light screen arrangement. Compared to conventional lighting fixtures capable of forming a light screen, it is thereby especially simple in its structural concept. A carrying rail, as in known ceiling/rail systems, is not required, even given a screen arrangement. A stable lamp housing is usually required in conventional lighting fixtures capable of forming a light screen that are realized without a separate carrying rail in order to assure the stability of the lighting fixture or, respectively, of the light screen arrangement as well as to accommodate the electrical and mechanical components. This is also not provided given the inventive lighting fixture structure. These structural functions are co-assumed by the design of the reflector arrangement. This is possible in that the web-shaped material from which the reflector arrangement is manufactured is stiffened, for example by surface shaping. A method disclosed by the International Patent Application WO 94/22612 can, in particular, be advantageously utilized for this surface processing. In turns of fabrication technology, the reflector arrangement can thus also be cost-beneficially realized with known tools. It is thus not only a light-oriented shaping element but a structural part at the same time that replaces a separate lamp housing.

It is thereby a particularly advantage to not only unite the reflector arrangement and the carrying rail to form, for instance, a unit but to manufacture these lighting fixture parts directly in one piece of thin-walled flat material by appropriate shaping.

In fabrication-oriented terms, such a solution can be realized without further ado with rolling shaping systems that are standard in lighting technology and, thus, cost beneficially as well. These possibility of being able to utilize this lighting fixture not only as a single lighting fixture but also in a light screen arrangement is established by appropriate face end parts that are pluggable into one another bent over without requiring additional connector elements therefor in this case.

The inventive long field lighting fixture or fixtures with a linear lighting field should, for example, also be employable in the rationalization of existing lighting systems in order to open up further possible applications of this solution. According to a second exemplary embodiment for a long field lighting fixture or fixtures with a linear lighting field capable of forming a light screen having a trough-shaped lamp housing securable to the ceiling of a room via suspensions and/or directly at whose end walls connector elements are provided for optionally joining individual long field lighting fixtures directly to one another to form a light screen, this has a single-piece reflector arrangement directly forming the lamp housing that is fashioned mirror-symmetrically with reference to a vertical middle lamp plane containing the longitudinal lamp axis, said reflector arrangement being fabricated of a thin-walled, web-shaped, reflective material whose surface is finely structured in stiffening fashion by surface shaping at least in sub-areas and, facing away from a light exit opening, comprises a pair of outwardly salient, mutually spaced legs for the acceptance of electrical and/or mechanical lighting fixture component parts;

further, respectively single-piece end wall parts whose inside facing toward the reflector arrangement comprises a plug in channel corresponding to the profile thereof; and further, fastening clips that comprise a pair of fingers that, forceps-like and proceeding from the side of the legs of the reflector arrangement, embrace the lateral surfaces thereof and form a receptacle for lamp holders for cable or suspender suspensions or, respectively, serve for attaching the lighting fixture directly to the ceiling.

By contrast to the above-described embodiment, individual fastening clips that can essentially be mounted at arbitrary locations in the longitudinal extent of the lighting fixture are utilized in this solution given an unmodified structural concept and appearance. In particular, this is also advantageous given rationalizations of old lighting equipment because existing ceiling fasteners of the lighting fixture(s) can continue to be employed. Moreover, this addition recites an alternative for the inventive lighting fixture capable of forming a light screen that satisfies the idea of a versatilely employable product family, as developments of both embodiments.

BRIEF DESCRIPTION OF THE DRAWINGS

FIG. 9 is an end view of another connector element for lighting fixtures combined to form a light screen as an alternative to the end face parts according to one of the FIGS. 1 through 5;

FIG. 10 is an end view of an embodiment of the lighting fixture wherein the light exit opening thereof is covered by a grid;

FIG. 11 is an end view of an embodiment of the lighting fixture with a channel mirror covering a light source in the direction toward the light exit opening of the lighting fixture; and FIG. 12 is and end view of another embodiment of the lighting fixture, whereby a covering of the light exit opening with a prism pane is provided instead of a channel mirror.

DESCRIPTION OF THE PREFERRED EMBODIMENTS

Figure 1:
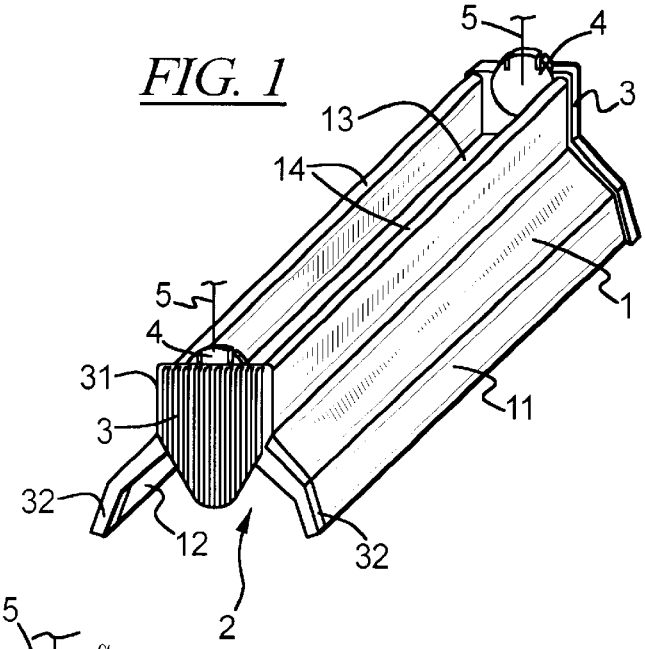
FIG. 1 is a perspective view of the fundamental structural format of an inventively fashioned lighting fixture with a reflector arrangement that directly forms the lamp housing.

In the exemplary embodiment of a lighting fixture capable of forming a light screen shown in FIG. 1, a reflector arrangement 1 is fashioned mirror-symmetrically relative to a vertical center plane containing the longitudinal lamp axis. It is shown by way of example that lateral surfaces 11 or, respectively, 12 of the reflector arrangement are composed of planar sub-surfaces; these lateral surfaces 11 or, respectively, 12, however could likewise be fashioned as conical sectional surfaces or, respectively, be composed of such surfaces. This means that it is up to a person skilled in the art in this case to select the profile design for these lateral surfaces 11 or, respectively, 12 for reasons of lighting technology.

An advantageous development of the reflector arrangement 1 is the provision of the arrangement 1 with a small-area surface structure, at least in sub-areas but also potentially completely. Methods for surface processing of web-shaped material are currently available and cost-beneficially enable a significant stiffening of the material. In terms of lighting technology, this means that the surfaces, for example the lateral surfaces 11 or, respectively, 12, of the reflector arrangement 1 preferably diffusely reflect the light output by a bulb arranged in its inside. A certain homogenization of the light stream emitted by the lighting fixture can thus be achieved with this reflector design in terms of its spatial distribution. Mechanically, the structuring of the surface of the reflector arrangement 1 has the further advantage that the rigidity thereof can be significantly increased when compared to a non-structured, smooth surface. Such a structuring thus also contributes to a considerable degree to the transverse stability of the lighting fixture, so that the thickness of the material of the reflector arrangement 1 can be selected correspondingly thinner in this case without a loss of stability.

In the region of a cover surface 13 that lies opposite the light exit opening 2, the reflector arrangement 1 comprises a pair of salient legs 14 that are mirror-symmetrically arranged relative to the center plane of the lamp at a predetermined spacing from one another. These legs 14 are respectively formed by two-fold bending of the web-shaped, thin-walled material of the reflector arrangement 1, where by this material is preferably selected from among the standard reflector materials for lighting fixtures. Together with the cover surface 13 of the reflector arrangement 1, the two legs 14 thus form an essentially U-shaped channel closed on three sides whose longitudinal axis lies in the center plane of the lamp and that is upwardly open facing away from the light exit opening 2. The interior of this channel is provided for accepting electrical and mechanical component parts of the lighting fixture, for example an electronic ballast means as an operating device for the bulb(s) of the lighting fixture, for lamp sockets plugged through the cover surface 13 as well as a lamp wiring. These details are not shown in FIG. 1 for reasons of clarity since a person skilled in the art is aware of design solutions therefor, for example from the ceiling/rail systems initially discussed.

In the embodiment shown in FIG. 1, terminating caps at the end faces of the reflector arrangement 1 are structurally fashioned such as end face parts 3 that the lighting fixture becomes capable of forming a light screen. Viewed in cross-sectional profile, the end face parts 3 have a middle region 31 that closes the channel formed by the legs 14 of the reflector arrangement 1 and tapers roughly triangularly downward in the direction of the light exit opening 2 of the lighting fixture and thereby covers a lamp socket that cannot be seen in FIG. 1. Following the cross-sectional contour of the reflector arrangement 1, outwardly directed fingers 32 are laterally applied to this middle region 31.

Figure 2:
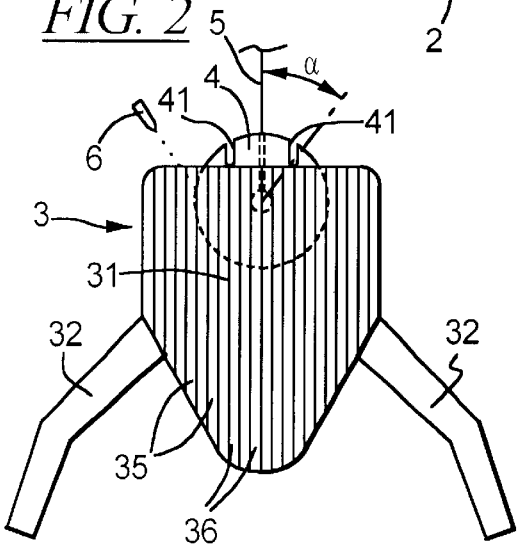
FIG. 2 is a view of an outer surface of an end face part of the light fixture of FIG. 1.
Figure 3:
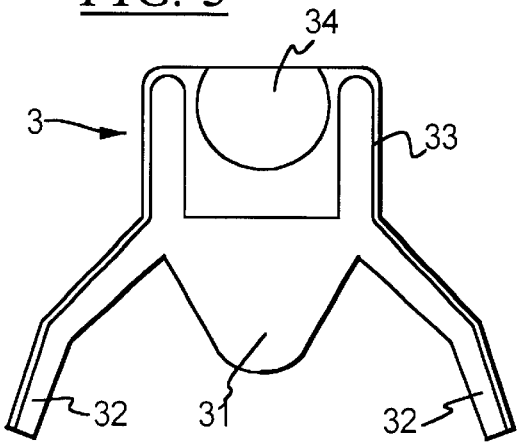
FIG. 3 is a view of an inner surface of an end face part of FIG. 2.
Figure 4:
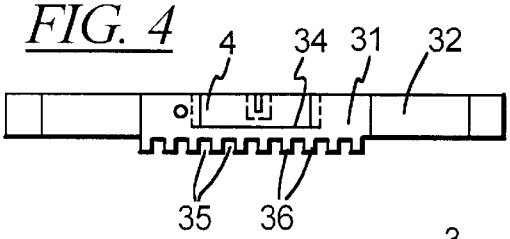
FIG. 4 is a top plan view of the end face part of FIG. 2.

FIGS. 2 through 4 each respectively show a view of the outside or, respectively, inside as well as a plan view of the end face part 3 for illustrating details in a somewhat larger scale. Following the outside contour close to the edge, a narrow plug channel or groove 33 for the acceptance of the face profile of the reflector arrangement 1 is provided at the inside—shown in FIG. 3—of the end face part 3. As a result of the approximately true-to-scale illustration of the end face part 3, this channel 33 can merely be seen in FIG. 3 as a somewhat thicker line. When assembling the lighting fixture, the face edge of the reflector arrangement 1 is inserted into this plug channel 33 and latched thereat. A number of possibilities are available to the person skilled in the art as latch means, for example in the form of face-parallel slots in the reflector arrangement 1 with which corresponding catch noses in the end face part 3 correspond, so that no more detailed explanation is required and a detailed illustration in the drawing has been foregone. Further, the inside of the end face part 3 comprises a circular segment-shaped recess 34 in its upper edge region whose significance as receptacle for a lamp holder shall be explained later.

It can also be seen in FIG. 2 and, in particular, in FIG. 4 that a tongue and groove profile composed of a plurality of channels 35 or, respectively, tongues or keys 36 following one another in succession is provided on the outside of the middle region 31 of the end face part 3, running parallel to the center plane of the lighting fixture. This profile has a defined division grid, i.e. the channels 35 or, respectively, tongues 36 comprise approximately the same width, as well as the same depth over and above this. In the overall impression of the illustrations in FIGS. 1 and 2, this tongue and groove profile 35, 36 appears completely uniform, so that the outside of the end face part 3 has a self-contained effect. When viewed more precisely, particularly on the basis of FIG. 4, however, an asymmetrical offset relative to the center plane of the lighting fixture becomes clear, since the tongue and groove profile terminates with a tongue or key at the left-hand edge of the middle region 31, whereas it terminates with an edge channel 35 at the right-hand edge.

Figure 5:
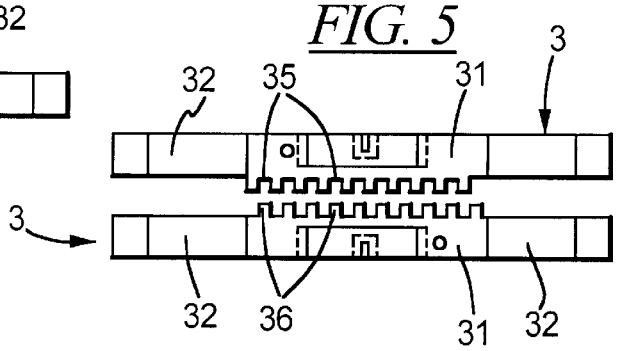
FIG. 5 is a top plan view illustrating how two end face parts can be placed against one another with exact contours.

The reason for this asymmetrical arrangement of the tongue and groove profile 35, 36 of the middle region can be seen from FIG. 5. in this illustration, two of the identically fashioned end face parts 3 are placed opposite one another; it is clear therefrom that the tongue and groove profiles 35, 36 of two end face parts 3 to be attached to one another, plugged into one another, enable an identically contoured joining of the end face parts 3 without, for instance, an alignment being required therefor.

The recess 34 in the form of a circular segment-shaped, cut blind hole shown in FIG. 3 is intended in this exemplary embodiment for accepting the lamp-side end piece of a lamp holder 4 forming a lighting fixture suspension. This is fashioned as a circular disk in this embodiment that can be placed into the end face part 3 proceeding from the inside. The lighting fixture suspension is shown as a wire-shaped suspender 5 by way of example in FIGS. 1 and 2. The disk-shaped fashioning of the lamp holder 4 allows the relative position thereof relative to the end face part 3 to be set, for instance, in an angular range $\alpha$—see FIG. 2. In an operating position, a position swivelled out of the vertical position can therefore be selected for the lighting fixture within this range, insofar as this is desired for the room illumination on a case-by-case basis. It is also schematically indicated in FIG. 2 that the relative position of the lighting fixture holder vis a vis the end face part 3 is non-positively fixed with a grub screw 6. This is also to be understood only by way of example because it would also be conceivable without further ado to fashion the connection of the lamp holder 4 and end face part 3 positively, for example with a denticulation.

FIGS. 1 and 2, finally, show that notches 41 are provided in the edge surface of the lamp holder 4 projecting from the end face part 3. Given a light screen arrangement of the lighting fixture, these serve as receptacles for a through wiring from a lighting fixture to a lighting fixture that can thus be simultaneously fixed.

Figure 6:
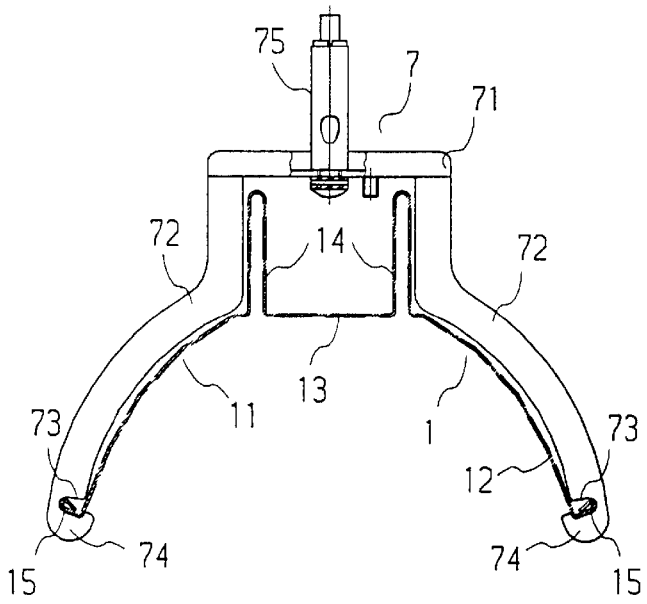
FIG. 6 is an end view of the housing with a clip for securing the fixture either directly to the ceiling or for suspension from the ceiling.
Figure 7:
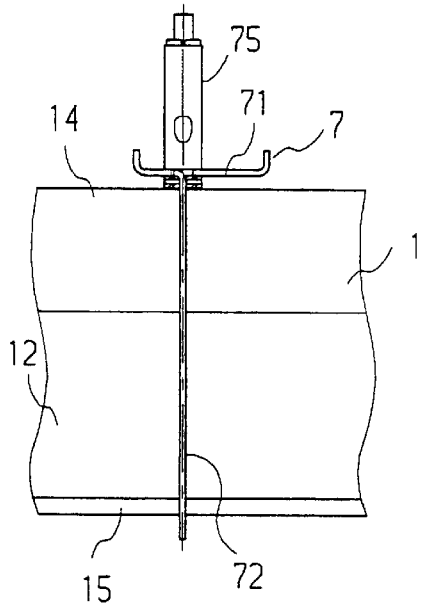
FIG. 7 is a side view of the clip of FIG. 6.

A further embodiment of the lighting fixture is shown in profile or, respectively, in a portion of a side view in FIGS. 6 and 7. In a modification of the above-described embodiment, individual fastening clips 7 are there by provided as lamp holder for a cable or suspender suspension of the lighting fixture. each fastening clip has a cover surface 71 as well as two fingers 72 laterally projecting from this cover surface 71 into which an inwardly disposed slot 73 is provided close to their outer ends. The profile of the fingers 72 is matched to the profile of the reflector arrangement 1, so that the fastening clip 7 can be inverted over the outside of the reflector arrangement 1. In this exemplary embodiment, the outside ends of the lateral surface 11, 12 of the reflector arrangement 1 are flanged outward and thus form lateral catch edges 15. Further, the fastening clips 7 are fashioned as a sheet metal part, whereby the cover surface 71 is composed of two planar elements bent at a right angle toward a respective side away from the plane of the legs 72.

During mounting of the fastening clip 7, the catch edges 15 of the reflector arrangement 1 snap into the respectively allocated slot 73 of the fastening clip 7. They are held in this position by a catch projection 74 that is arranged at the outer ends of the fingers 72 on their inside and projects slightly beyond a bottom surface of the slot 73. The cover surface 71 of the fastening clip 7 now serves in a known way for the acceptance of a cable or suspender suspension of the lighting fixture. In the illustration selected in FIG. 6 or, respectively, 7, for example, a cable suspender 75 is provided therefor in which a lamp-side end of a cable (no longer shown) is to be displaceably fixed for ceiling compensation. It can be easily understood by a person skilled in the art that the cover surface 71 of the fastening clip 7 can also be inherently fixed without further ado directly to the ceiling of a room with a screw connection, so that no further example is required therefor.

Figure 8:
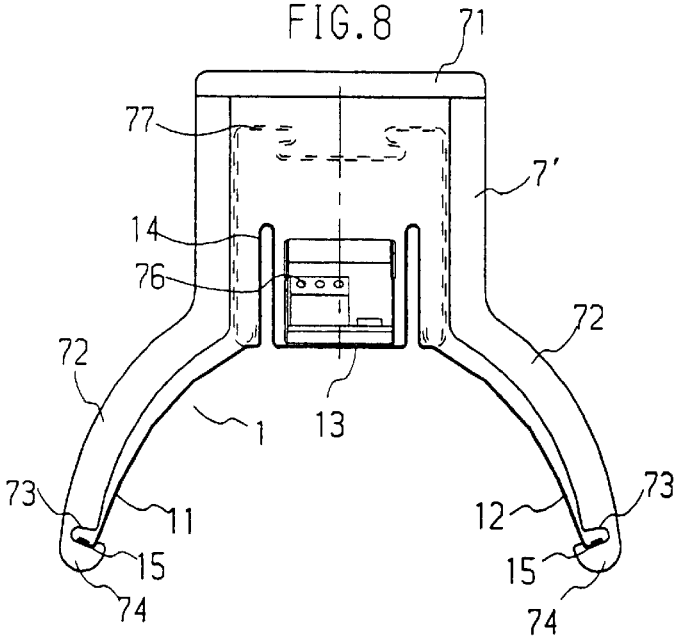
FIG. 8 is an end view of an embodiment of a fastening clip for a further embodiment of such a fastening clip for mounting the lighting fixture at a carrying rail of a conventional light screen arrangement.

FIG. 8 shows a further embodiment of the above-described fastening clip 7. Given this embodiment of the fastening clip 7', the clear cross-section of the space surrounded on three sides by the cover surface 71 and the adjacent foot ends of the fingers 72 is fashioned such that, in profile, it embraces a carrying rail 77 of one of the known ceiling and rail systems for light screen arrangements. With this embodiment of the fastening clip 7', which is identical to the fastening clip 7 described with reference to FIG. 6 in terms of its further function, it is possible to also utilize the lighting fixture described here in rationalizations of ceiling and rail systems wherein, as usual, a carrying rail 77 is used as the carrying element. As a schematic detail, further, FIG. 8 shows an electronic ballast means 76 as operating means for the described lighting fixture that is placed onto the cover surface 13 of the reflector arrangement 1 arranged between its two legs 14.

FIG. 9 shows a further embodiment of the lighting fixture wherein, in a modification of the embodiment particularly described with reference to FIG. 4 and 5, the end face parts 3 themselves are not utilized for connecting two or more individual lighting fixtures to form a light screen. On the contrary, an individual connector element 8 is utilized for the realization of this function. This is essentially composed of two clamps 81 and 82 that are fixed to one another by a screwed connection 83, 84, 85. Each of the two clamps 81 and 82 of the connector element 8 comprises legs laterally crimped U-shaped by a plate serving for the acceptance of the screwed connection 83 through 85. in the case of the one clamp 81, the clearance between its legs is selected such that it can thus be respectively inserted into the profile or gap of the doubly crimped legs 14 of the reflector arrangement 1. In a mirror-symmetrical arrangement thereto, the second clamp 82 is placed between the two legs 14 of the reflector arrangement 1 with the ends of its legs seated on the cover surface 13 of the reflector arrangement 1. The one clamp 81 of the connector element 8 thus embraces the cover surface 13 of the reflector arrangement 1 from below, whereas the other clamp 82 thereof, guided at the insides of the legs 14 of the reflector arrangement 1, sits on the cover surface 13 thereof. The screwed connection between the two clamps 81 and 82 is then formed by a connecting screw 83, a toothed washer 84 put in place thereon as well as a lock washer 85. the connecting screw 83 introduced together with the toothed washer 84 in the one clamp 81 of the connector element 8 via a bore (not shown) is held captive thereat with the lock washer 85. When the connecting screw 85 is screwed into a threaded bore (likewise not shown) of the plate of the other clamp 82, the two clamps 81 and 82 of the connector element 8 are clamped against the reflector arrangement 1, particularly the cover surface 13 thereof, proceeding from two sides.

When the connector element 8 is arranged respectively overlapping the end or face region of two lighting fixtures placed directly against one another at the face side and is screwed in the described way in each face region, then the two lighting fixtures are non-positively fixed to one another.

In particular, the two lighting fixtures placed against one another are also in alignment in their longitudinal axis without adjustment because the one clamp 81 of the connector element 8 is guided in the clearcross-section of the legs 14 of the reflector arrangement 1 and the other clamp 82 has its slightly outwardly spread legs engaging at the bent edges between the cover surface 13 of the reflector arrangement 1 and the legs 14 thereof.

The embodiment described above with reference to FIG. 8 for the connection of two lighting fixtures placed against one another to form a light screen is to be advantageously applied instead of the first embodiment described on the basis of FIGS. 1 through 5 when longer light screens or rows of lights are to be formed in this way and a structurally especially dependable lighting fixture connection seems required in an application m a rough operating environment.

It should be added in view of lighting technology that the above-described embodiments of the lighting fixture can, of course, be completed by further accessory parts in order to realize light distributions adapted to an application. When desired, thus, the reflector arrangement 1 can be fashioned translucent, so that a part of the light emitted from a bulb inserted within the reflector arrangement 1 there against passes through it and thus serves as secondary light, for example for ceiling illumination.

As schematically illustrated in FIG. 10, a grid for transverse deglaring can be provided in the light exit opening 2 of the lighting fixture. As in the embodiment described with reference to FIG. 6, the laterally outwardly flanged outside edges of the lateral surfaces 11, 12 of the reflector arrangement 1 can be utilized in this case to snap such a grid into the light exit opening 2 of the lighting fixture and fix it in latching fashion at the reflector arrangement 1.

For further augmentation, FIG. 11 schematically shows a further embodiment of the lighting fixture in cross-section. In this case, a bulb, preferably a rod-shaped fluorescent bulb 9 is introduced into the reflector arrangement 1. In the direction of the light exit opening 2 of the lighting fixture, a channel mirror 92, that extends in the direction of the longitudinal axis of the lighting fixture and is thus aligned parallel to the bulb 9 and that partially coaxially embraces the bulb 9, is provided below the bulb 9. This channel mirror 92, which is fixed to the bulb 9 in the exemplary embodiment, reflects light, which is emitted by the bulb 9 directly in the direction of the light exit opening 2 of the lighting fixture, against the reflector arrangement 1 and thus acts as a diffusor as well as an occlusion element for the bulb 9.

FIG. 12 schematically shows another possibility of glare reduction of the lighting fixture. In this case, the light exit opening 2 of the lighting fixture is covered by a prism pane 93. In a way similar to that of the channel mirror 92 of FIG. 11, a light distribution is thus effected by deflection of the light, which is emitted by the bulb 9 directly in the direction of the light exit opening 2 of the lighting fixture, and this deflection reduces the great differences in luminous radiation that occur locally in the light exit opening 2 of the lighting fixture. In this case, too, longitudinal edges of the prism pane 93 can be mounted in a holder 94 that, analogous to the fashioning of the outer ends of the fingers 72 of the fastening clip 7 according to FIG. 6, is shaped such that a latched connection between the two lighting fixture elements is enabled with a tongue and groove connection between the prism pane 93 and the reflector arrangement 1.

The embodiments, which are described above on the basis of the drawing, show that, based on a shared system concept with few, particularly economical lighting fixture components, a family of lighting fixtures can be realized that can give a uniform appearance and can be used both for a new design and/or for a rationalization of a lighting system. In addition to the described embodiments, a person skilled in the art has further possibilities available to adapt the lighting fixture design to boundary conditions of the application while developing the system concept. For achieving, for example, desired light distribution characteristics of the lighting fixture, he can thus adapt the profile of the reflector arrangement and/or change the position of the lamps used as light source relative to the reflector arrangement.

What is claimed is:

1. A lighting fixture with a linear lighting field, said fixture being capable of forming a light screen, said fixture having a trough-shaped lamp housing securable to a ceiling of a room, said lamp housing being formed by a single-piece reflector arrangement that is fashioned mirror-symmetrically with reference to a vertical metal lamp plane containing the longitudinal lamp axis, said reflector arrangement being fabricated of a thin-wall, web-shaped, reflective material, whose surface is finely structured in a stiffening fashion by surface shaping at least in sub-areas, said reflector arrangement, along one side, having a light exit opening and, facing away from said light exit opening, having a pair of outwardly salient mutually spaced legs for acceptance of electrical and mechanical lighting fixture components, said housing having connector elements to provide an optional joining of individual fixtures directly to one another to form the light screen, said connector elements being formed as universal single-part end face parts having inside surfaces facing the reflector arrangement comprising a plug channel corresponding to a profile of the reflector arrangement and having an outside surface with a tongue and groove profile composed of a plurality of channels and tongues of identical width that extend parallel to one another as well as to the center plane of the lighting fixture and follow one another in alternation, said tongue and groove profile arrangement being asymmetrical to the center plane of the lighting fixture so that identically fashioned end face parts can be joinable to one another at the outer surfaces in pairs and align their respective reflector arrangements.

2. A lighting fixture according to claim 1, wherein the outwardly salient legs of the reflector arrangement are fashioned as doubly flanged projections that together form an outwardly open profile having a U-shaped cross-section.

3. A lighting fixture according to claim 2, wherein the end face parts comprise a plate-shaped central region that embraces the U-shaped profile of the salient legs of the reflector arrangement, said central region carrying the tongue and groove profile on its outer surface facing away from the reflector arrangement and from which a pair of fingers project outwardly downward fork-shaped for receiving the end edges of the reflector arrangement.

4. A lighting fixture according to claim 2, wherein the end part comprises a recess in the region of the U-shaped profile legs on an inside surface and includes a lamp holder being introduced in said recess and forming a lamp-side end piece of a lighting fixture suspension system.

5. A lighting fixture according to claim 4, wherein the lamp holders are fashioned as plate-shaped disks designed circularly in cross-section.

6. A lighting fixture according to claim 5, wherein the recess in the end face part serves for acceptance of the lamp holder and is arranged to intersect an upper edge of the end face part, wherein the lamp holder placed therein partially projects beyond the upper edge of the end face part.

7. A lighting fixture according to claim 6, wherein the lamp holder has notches provided on an edge region projecting from the upper edge of the end face part, said notches serving for accepting and fixing a through-wiring from lighting fixture to lighting fixture given a light screen arrangement.

8. A lighting fixture according to claim 1, wherein the end face parts are fashioned as injection-molded parts.

9. A lighting fixture according to claim 1, wherein catch means are provided for securing a plug connection between the reflector arrangement and the end face parts.

10. A lighting fixture according to claim 1, which includes means for influencing the light distribution of the light passing through the light exit opening of the light fixture, said means steering the light emitted by at least one rod-shaped bulb inside the reflector arrangement.

11. A lighting fixture according to claim 1, wherein the reflector arrangement is fashioned as a translucent member.

12. A lighting fixture with a linear lighting field, said fixture being capable of forming a light screen, said fixture having a trough-shaped lamp housing securable to a ceiling of a room, said lamp housing comprising a single-piece reflector arrangement that is fashioned mirror-symmetrically with reference to a vertical middle lamp plane containing a longitudinal lamp axis, said reflector arrangement being fabricated of a thin-wall, web-shaped, reflecting material, whose surface is finely structured in a stiffening fashion by surface shaping at least in sub-areas, said reflector arrangement, along one side, having a light exit opening, and having a pair of outwardly salient mutually spaced legs for acceptance of electrical and mechanical lighting fixtures facing away from said light exit opening, said housing having end face parts having inside surfaces facing toward the reflector arrangement comprising a plug channel having a profile corresponding to the profile of the reflector arrangement, and fastening clips comprising a pair of fingers that embrace the lateral surfaces of the reflector arrangement forceps-like proceeding from the side of the legs thereof and forming a receptacle for the light holder for securing the light fixture into the ceiling.

13. A lighting fixture according to claim 12, wherein the reflector arrangement is made of translucent material.

14. A lighting fixture according to claim 12, which includes additional means for influencing the light distribution of the light passing through the light exit opening of the lighting fixture, said means steering the light emitted by at least one rod-shaped bulb arranged inside of the reflector arrangement.

15. A lighting fixture according to claim 12, wherein the free edges of the lateral surfaces of the reflector arrangement are flanged to form a catch edge, said fingers of the fastening clips adjacent the free ends having a slot for receiving the catch edges for fixing in a latching fashion.

16. A lighting fixture according to claim 15, which includes connector elements for attaching two lamp housings in alignment, said connector elements having two clamps fashioned U-shaped in cross-section, one of said clamps having legs guided in the profile of the doubly flanged legs of the reflector arrangements and the other clamp being inserted in a clear cross-section between the legs of the reflector arrangements being mirror-symmetrical relative to the first clamp, and means for a screw connection to clamp the two clamp elements together in a clamping fashion.

17. A lighting fixture according to claim 12, which includes means for end face connection of a pair of housings with alignment, said means comprising connecting elements having two clamps fashioned U-shaped in cross-section, one of said clamps having legs guided in the profile of the doubly flanged legs of the reflector arrangements and the other clamp being inserted in the clear cross-section between the legs, and fastening means for securing the two clamp elements together in a clamping arrangement.

* * * * *